US006584880B1

(12) United States Patent
Pahl et al.

(10) Patent No.: US 6,584,880 B1
(45) Date of Patent: Jul. 1, 2003

(54) ELECTRONICALLY CONTROLLED ARMING UNIT

(75) Inventors: Randall Pahl, Indianapolis, IN (US); Marcus Snell, Greenwood, IN (US); Carl Nicodemus, Indianapolis, IN (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/774,337

(22) Filed: Jan. 30, 2001

(51) Int. Cl.[7] ..... B64D 1/04; F41F 5/00

(52) U.S. Cl. ..... 89/1.55; 294/82.26; 102/221

(58) Field of Search ..... 89/28.1, 1.55; 294/82.24, 82.26; 102/223, 357, 221

(56) References Cited

U.S. PATENT DOCUMENTS 4,266,462 A * 5/1981 Carter et al. ..... 89/1.55
4,407,180 A * 10/1983 Regnat ..... 89/1.53
4,520,711 A * 6/1985 Robinson ..... 244/137.4
4,528,890 A * 7/1985 Carter ..... 294/82.26
4,682,530 A * 7/1987 Brown et al. ..... 294/82.26
4,936,187 A * 6/1990 Teeter ..... 89/1.55
4,987,820 A * 1/1991 Gordon ..... 294/82.26
5,042,357 A * 8/1991 Schaff et al. ..... 102/200
5,305,676 A * 4/1994 Conrad et al. ..... 294/82.32
5,821,447 A * 10/1998 Reams et al. ..... 102/223
6,289,817 B1 * 9/2001 Quebral et al. ..... 102/357

* cited by examiner

*Primary Examiner*—Michael J. Carone
*Assistant Examiner*—Troy Chambers
(74) *Attorney, Agent, or Firm*—William C. Schubert; Glenn H. Lenzen, Jr.

(57) ABSTRACT

An electronically controlled arming unit including a logic circuit that is driven by the pre-existing weapons system signals to control a lanyard locking unit, thus removing the need for an external force to operate the arming unit. The electronically controlled arming unit can be retrofitted to the existing equipment.

16 Claims, 6 Drawing Sheets

ELECTRONICALLY CONTROLLED ARMING UNIT

BACKGROUND OF THE INVENTION

1. Field of the Invention

This invention relates to an arming unit retention mechanism and, more particularly, relates to electro-mechanical arming units.

2. Description of the Related Art

Arming unit retention mechanisms are used in conjunction with bomb racks, aircraft pylon, or other weapons release systems with weapons which are armed by the pulling of a lanyard. In these arming unit systems, a hook or plunger retains the weapon lanyard such that when the weapon is released, the lanyard is pulled, and the weapon is armed by the pulling of the lanyard. Additionally, at times it is desired to release an unarmed weapon. These arming unit systems permit the hook to be disengaged from the weapon lanyard such that when the weapon is released, the lanyard is not pulled, and the weapon is released unarmed.

In addition to providing the arming function described above, arming units are also used to accommodate high drag or low drag bomb release. In this case, the weapon has fins adapted to be extended and retracted. In the extended position, the fins provide high wind resistance or drag. In the retracted position, the fins provide low wind resistance or drag. In these systems, the hook or plunger retains the drag lanyard such that when the weapon is released, the drag lanyard is pulled, and the fins are extended by the pulling of the lanyard. Alternately, the hook is disengaged from the drag lanyard such that when the weapon is released, the drag lanyard is not pulled, and the fins remain retracted.

Two types of arming unit (hereinafter "AU") retention mechanisms are commonly known in the art, conventional AU technology and zero retention force (hereinafter "ZRF") AU technology.

As described above, at times it is desired to release an unarmed weapon. In conventional AU mechanisms, in order to release an unarmed weapon the user must provide the force necessary (typically 10–12 pounds of force) to disengage the hook from the lanyard. If the user is unable to provide this force, or if the mechanism fails for whatever reason, the AU does not open and an armed weapon may be released instead of the desired unarmed weapon.

In ZRF AU mechanisms, the lanyard is disengaged by the driving of a mechanical linkage opening the lanyard hook. If this mechanism fails for whatever reason, the ZRF AU does not open and an armed weapon is released instead of the desired unarmed weapon.

Both the conventional AU and the ZRF AU require a force external to the AU (e.g. the user or driving of a mechanical linkage) to release the lanyard. Therefore, there is a continuing need for an electrically operated arming unit retention mechanism that is driven by pre-existing weapons system signals, and that removes the need for external forces to lock the arming unit.

Prior art AU's, as shown in FIGS. 1 through 3, are used in conjunction with bomb racks and operate in three modes: Normal mode, Armed/Locked mode (hereinafter "Locked"), and Open mode. Weapon release systems utilize an arming signal 20 to signal the mode to the AU. Weapon release systems also have a firing signal 21 to provide power to the bomb rack to release the weapon.

The prior art ZRF AU 5 shown in FIG. 1 is in the Normal mode. In the Normal mode, a weapon 10 is loaded into a bomb rack (not shown) with arming lanyard 8 disposed between a lanyard hook 9 and a lanyard plunger 11 of ZRF AU 5. Lanyard plunger 11 is operable to extend into contact with lanyard hook 9 and is operable to retract into ZRF 5. In the Normal mode, lanyard plunger 11 is extended into lanyard hook 9. engaging arming lanyard 8 between lanyard plunger 11 and lanyard hook 9.

Lanyard plunger 11 is operable to extend and retract via the movement of an arming linkage 12. A bomb rack (not shown) is adapted to provide a linkage force 14 to arming linkage 12 disposed on ZRF 5. Linkage force 14 acts to pivot arming linkage 12 about one of two pivot points. A mechanism 6 (not shown) within ZRF 5 is adapted to allow arming linkage 12 to pivot about either an arming pivot point 13 or an unarming pivot point 15.

In the Open mode, shown in FIG. 2, mechanism 6 operates to allow arming linkage 12 to pivot about unarming pivot point 15. When pivoting about unarming pivot point 15, arming linkage 12 retracts lanyard plunger 11 from lanyard hook 9, thus disengaging lanyard 8 from ZRF 5. The Open mode permits release of an unarmed weapon 10. To achieve the Open mode, the user does not provide an arming signal 20 to ZRF S via wire terminals 7. When ZRF 5 receives linkage force 14 to arming linkage 12 upon weapon release, the ZRF 5 arming linkage, by default, pivots about unarming pivot point 15, causing the release of the unarmed weapon 10.

In the Locked mode, shown in FIG. 3, mechanism 6 operates to allow arming linkage 12 to pivot about arming pivot point 13. When pivoting about arming pivot point 13, arming linkage 12 does not retract lanyard plunger 11 from lanyard hook 9, thus leaving lanyard 8 engaged to ZRF 5. The Locked mode permits release of an armed weapon 10. To achieve the Locked mode, the user provides arming signal 20 to ZRF 5 via wire terminals 7 to activate the Locked mode. ZRF 5 receives arming signal 20 which activates mechanism 6 to allow arming linkage 12 to pivot about arming pivot point 13. The bomb rack is opened upon the user providing firing signal 21. Firing signal 21 causes the bomb rack to provide linkage force 14 to arming linkage 12. Linkage force 14 pivots arming linkage 12 about arming pivot point 13, causing the release of the armed weapon 10.

Additionally, the current equipment in the field is equipped with either one of the two above mentioned systems. Accordingly, there is a continuing need for an electrically operated arming unit retention mechanism which can be retrofitted to the existing equipment.

SUMMARY OF THE INVENTION

The teachings of this invention relate to logic circuitry for a weapon arming unit, the circuitry being driven by pre-existing weapons system signals, and that beneficially removes the need for external forces to open the arming unit for safe release.

The apparatus of the present invention provides for an electrical controlled arming unit which removes the need for an external force to operate the unit. The present invention uses a logic circuit that is driven by the pre-existing weapons system signals to remove the need for external forces to open the arming unit.

DESCRIPTION OF PREFERRED EMBODIMENT

The present invention offers the opportunity to retrofit current AU's, either conventional AU's or ZRF AU's, with an electronically controlled arming unit which includes a logic circuit that is driven by the pre-existing weapons system signals and that removes the need for an external force to operate the AU.

Figure 1:
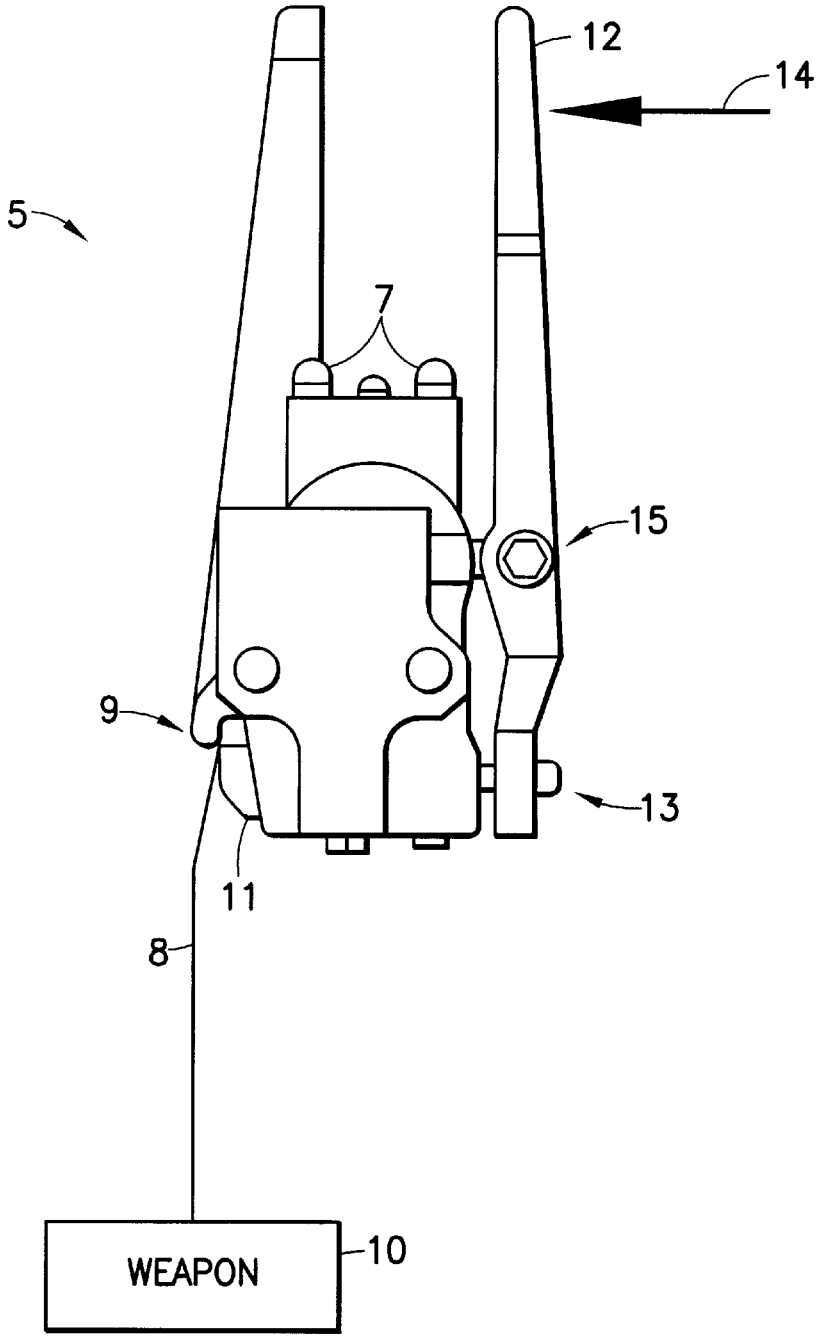
FIG. 1 PRIOR ART
FIG. 1 is a side view of the prior art ZRF arming unit in Normal mode.
Figure 2:
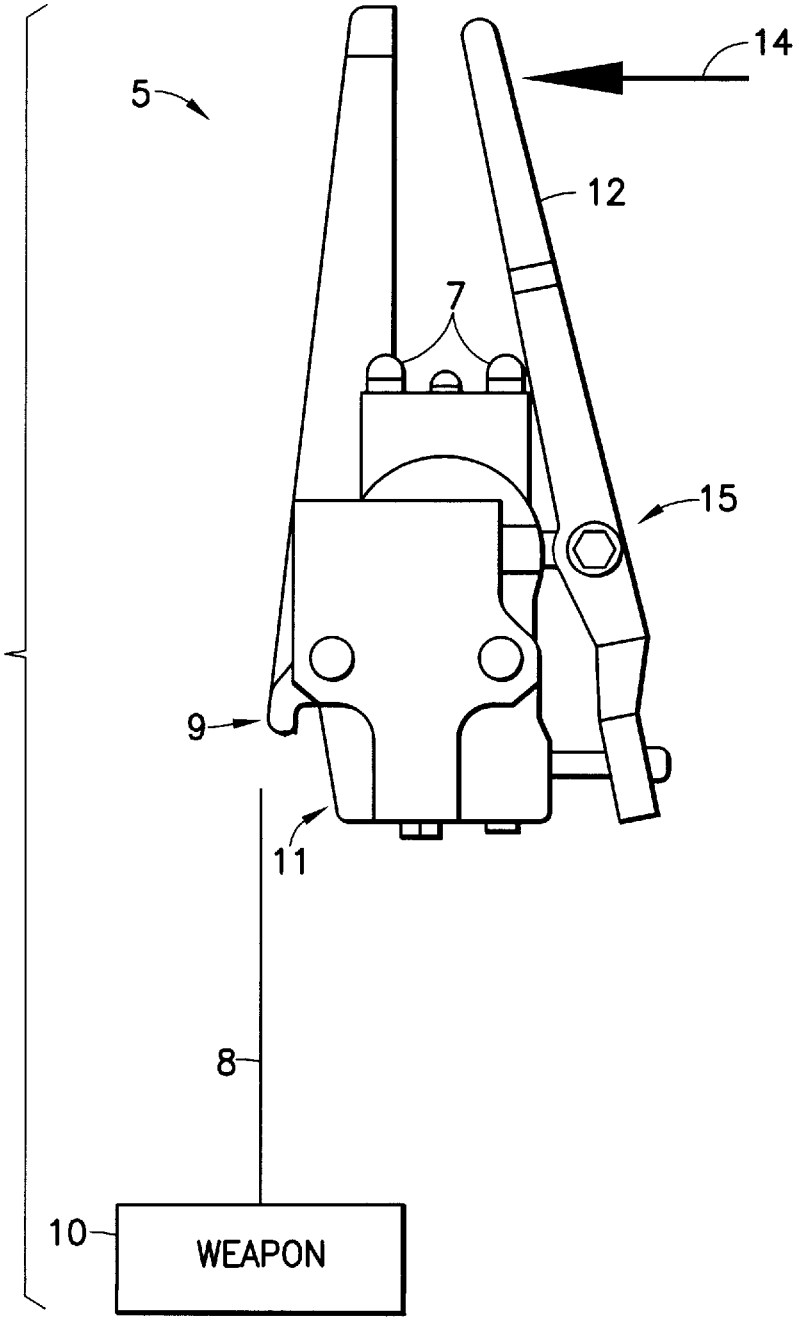
FIG.2 PRIOR ART
FIG. 2 is a side view of the prior art ZRF arming unit in Open mode.
Figure 3:
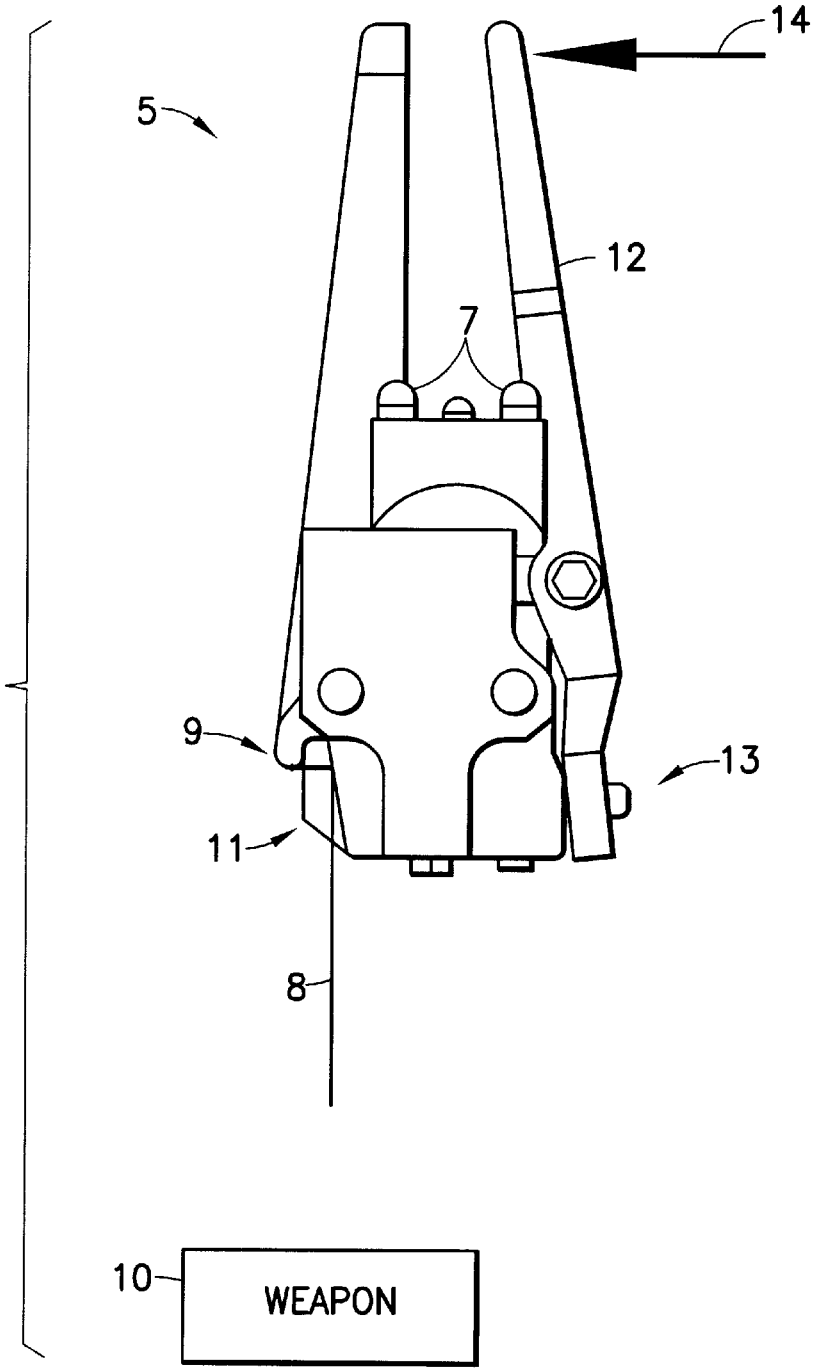
FIG.3 PRIOR ART
FIG. 3 is a side view of the prior art ZRF arming unit in Locked mode.
Figure 4:
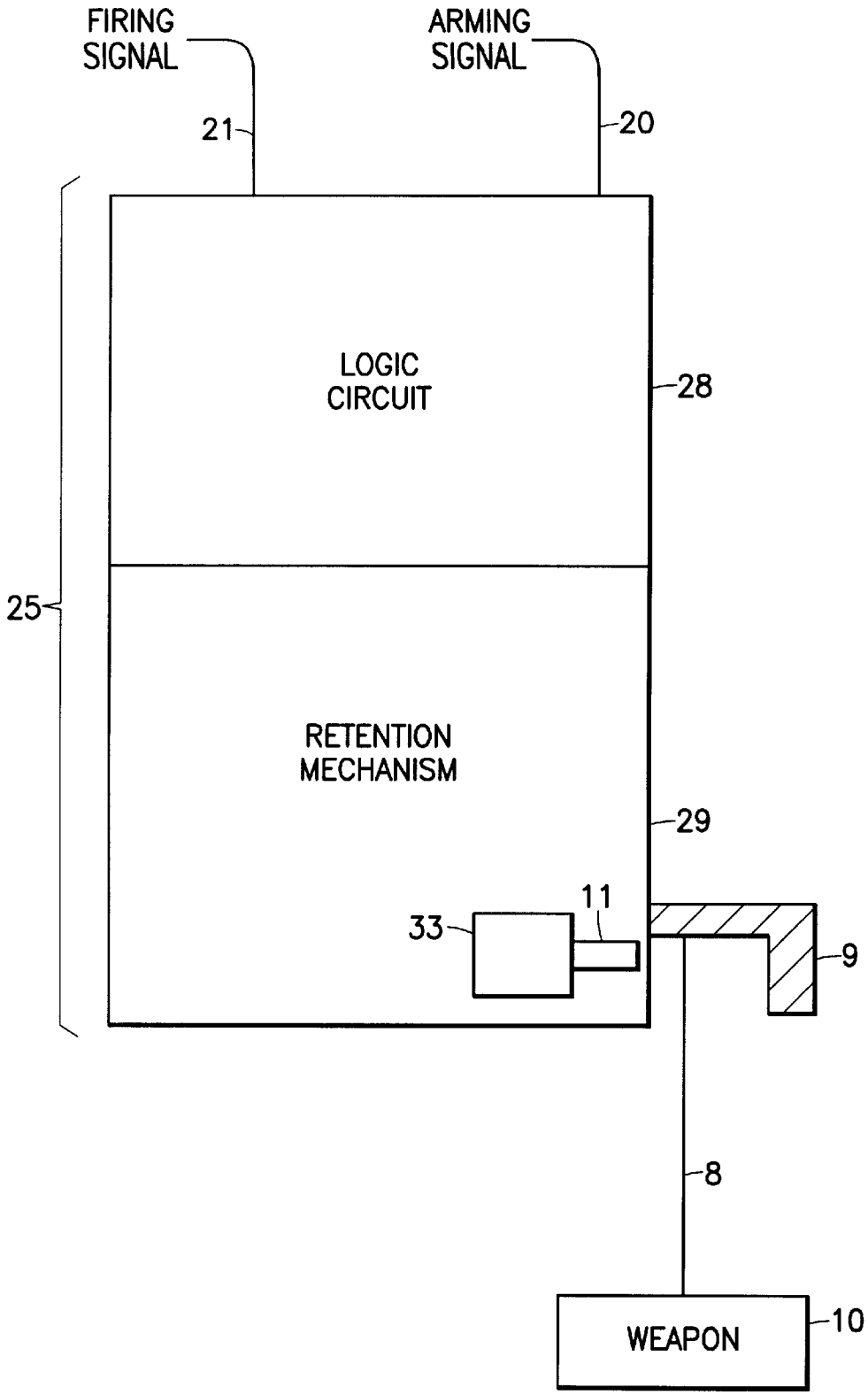
FIG. 4 is the arming unit of the present invention.

In contrast to the prior art ZRF 5 described above, the electronically controlled arming unit 25 ("ECAU"} of the present invention, shown in FIG. 4, includes a logic circuit 28 and a lanyard retention mechanism 29. Logic circuit 28 is driven by both the arming signal 20 and the firing signal 21. Logic circuit 28, shown in FIG. 4, is included with lanyard retention mechanism 29 in ECAU 25. In an alternate embodiment of the present invention, logic circuit 28 is remote from lanyard retention mechanism 29.

Lanyard retention mechanism 29 is adapted to engage and disengage lanyard 8 of weapon 10 in response to logic circuit 28. In the preferred embodiment of FIG. 4, lanyard retention mechanism 29 has a solenoid 33 to extend and retract lanyard plunger 11 toward and from lanyard hook 9, thus engaging and disengaging lanyard 8 between plunger 11 and lanyard hook 9.

The ECAU 25 includes a Normal mode, an Locked mode, and an Open mode. In a first embodiment shown in FIG. 4, the modes are determined by logic circuit 28 in response to the existing arming signal 20 and firing signal 21, or lack thereof. Logic circuit 28 is provided arming signal 20 and firing signal 21 via standard electrical connections 51.

Figure 5:
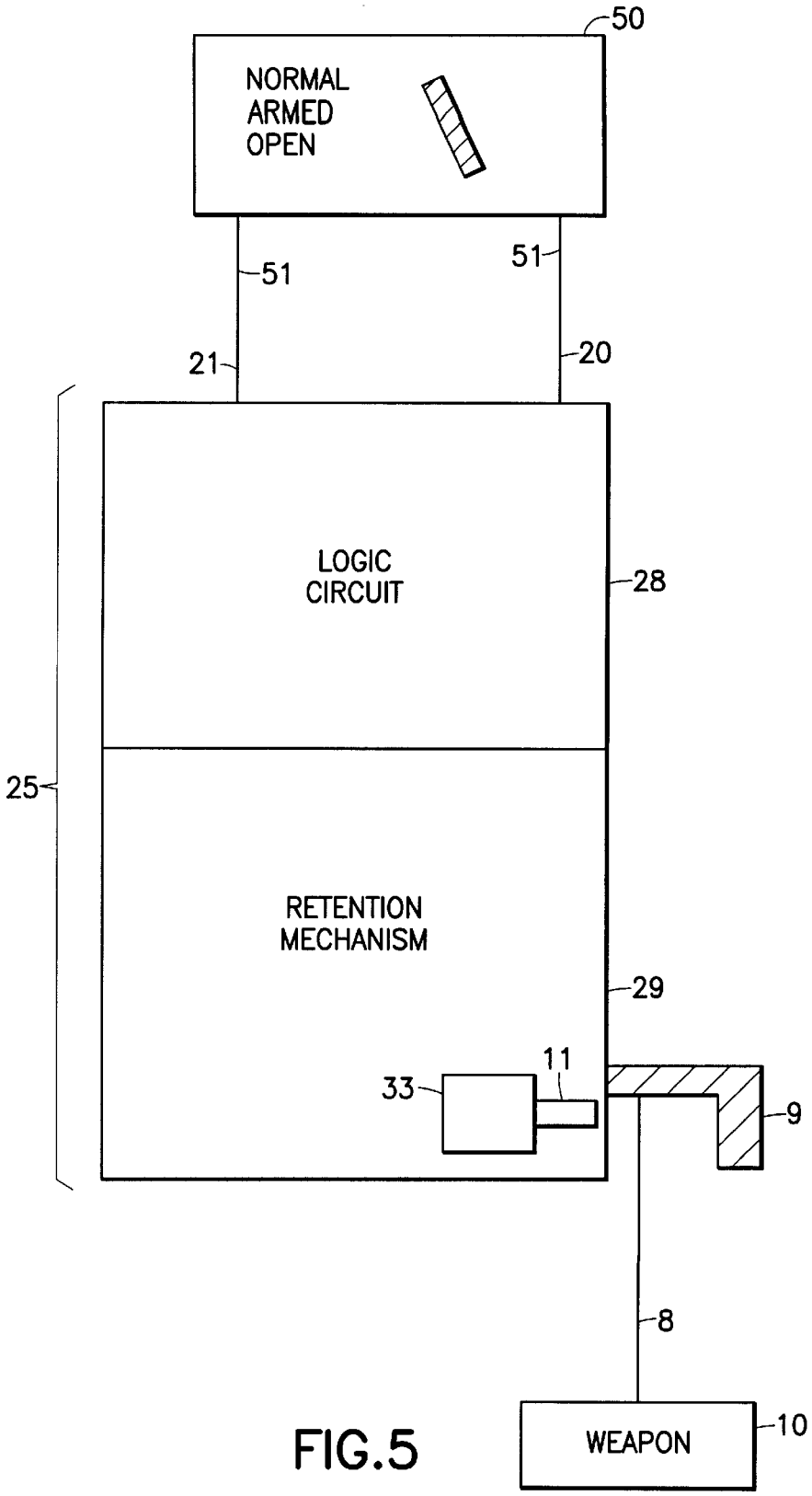
FIG. 5 is a selector unit embodiment of the arming unit of the present invention.

In an alternate embodiment shown in FIG. 5, arming signal 20 and firing signal 21 are selected by the user via a selector unit 50. Selector unit 50 is a manual selector or an automatic selector, such as, but not limited to, a multiple position manually driven or electrically drive switch. Selector unit 50 is couple to logic circuit 28 via standard electrical connections 51.

In the Normal mode, neither firing signal 21 nor arming signal 20 is present. In the Normal mode, logic circuit 28 controls retention mechanism 29 to retain lanyard 8, without locking it and no weapon 10 is released.

In the Open mode, firing signal 21 is present but arming signal 20 is not present. Firing signal 21 releases the weapon from the aircraft. In the Open mode, logic circuit 28 controls retention mechanism 29 to open, disengaging lanyard 8 before releasing weapon 10. Thus, the Open mode releases an unarmed weapon.

In the Locked mode, arming signal 20 is present and firing signal 21 is either present or not present. In the Locked mode, logic circuit 28 control retention mechanism 29 to lock close, locking lanyard 8 within retention mechanism 29. If firing signal 21 is present, a weapon is released and the locked arming unit retains the lanyard and an armed weapon is released. Alternately, if firing signal 21 is not present but the weapon is released for another reason, such as mechanical failure, the locked arming unit retains the lanyard and an armed weapon is released.

The preferred embodiment of ECAU 25 includes a provision of a fail safe retention mechanism. Fail safe retention mechanisms permit the release of unarmed weapons from ECAU 25, when in the Normal mode, in the event of inadvertent weapons release. Moreover, fail safe retention mechanisms permit the release of unarmed weapons from ECAU 25, when in the Open mode or Locked mode, in the event of mechanical or electrical failure of ECAU 25, logic circuit 28 and/or retention. mechanism 29. Thus, if there is a failure of ECAU 25, logic circuit 28 and/or retention mechanism 29, the ECAU by virtue of the fail safe retention mechanism, will default to the Normal mode which prevents the release of an armed weapon. Current arming units do not release lanyard 8 if there is a failure in the mechanical linkage to the arming unit.

In a preferred embodiment, retention mechanism 29 is the fail safe arming unit mechanism as described in commonly owned U.S. patent application Ser. No. 09/774,483 filed on Jan. 30, 2001 which is hereby incorporated by reference.

Figure 6:
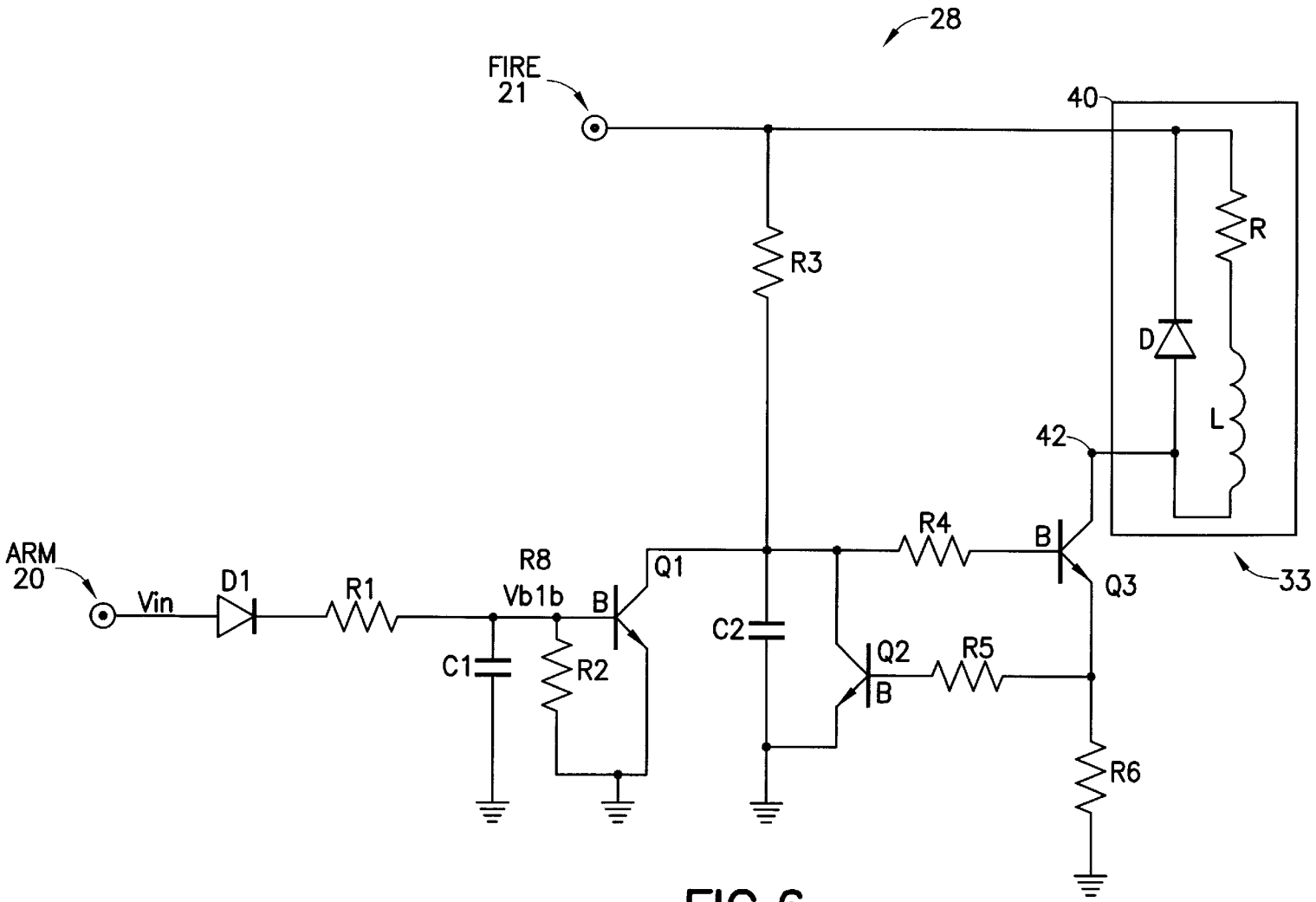
FIG. 6 is a diagram of a logic circuit of the present invention.

One possible logic circuit 28 that includes solenoid 33 is shown in FIG. 6. An equivalent circuit is shown for solenoid 33. In the preferred embodiment, firing signal 21 and arming signal 20 are 28*v* electrical signals.

In the Normal mode with neither firing signal 21 nor arming signal 20 present, no power is present across solenoid 33, and thus the solenoid remains extended, thereby remaining engaged with lanyard 8.

In the Open mode with firing signal 21 present and arming signal 20 not present, firing signal 21 applies power to the top end 40 of solenoid 33, to R3, and thus to the base (B) of Q3, thereby turning on Q3 for conduction and grounding the bottom end 42 of solenoid 33. Since arming signal 20 is not present, the power from firing signal 21 across solenoid 33 retracts the solenoid, disengaging lanyard 8. The Open mode releases an unarmed weapon.

In the Locked mode with arming signal 20 present, power is applied to the base (B) of Q1. As discussed above, if firing signal 21 is present, it applies power to top end 40 of solenoid 33, to R3 and thus to the base (B) of Q3. The signal at the base of Q3 turns on Q3, thereby grounding the bottom end 42 of solenoid 33. However, Q1 is also turned on and pulls down the signal at the junction of R3 and R4, which prevents Q3 from being turned on. In this case, no power is present across solenoid 33, and the solenoid remains extended, thus remaining engaged with lanyard 8. An armed weapon 10 is thus released when firing signal 21 is on and no weapon 10 is released if firing signal 21 is off.

In the event a short circuit develops in solenoid 33, a voltage above a predetermined limit develops across R6. The voltage above the predetermined limit is fed through R5 to the base (B) of Q2, turning Q2 on and pulling down the junction of R3 and R4. This is coupled through to the base (B) of Q3 through R4. This self generating signal shuts off Q3, and prevents Q3 from being damaged, or excessive current being pulled out of firing signal 21. If a short to ground develops between solenoid 33 and Q3, power is presented across solenoid 33, thus the solenoid retracts, disengaging lanyard 8, and releasing an unarmed weapon 10.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

We claim:

1. An electronically controlled apparatus for arming a weapon armed by pulling a lanyard upon release of the weapon from a weapon base, the apparatus comprising:

a lanyard retention mechanism adapted to engage with and disengage from the lanyard connected to the weapon; and a logic circuit having inputs to receive at least two pre-existing weapons system signals, wherein said logic circuit is adapted to control said lanyard retention mechanism in response to said weapons system signals, and wherein said lanyard retention mechanism is adapted to engage with and disengage from the lanyard in response to said logic circuit.

2. The electronically controlled apparatus of claim 1, wherein said lanyard retention mechanism is a fail safe retention mechanism.

3. The electronically controlled apparatus of claim 1, wherein said lanyard retention mechanism has a solenoid adapted to engage and disengage the lanyard from said lanyard retention mechanism.

4. The electronically controlled apparatus of claim 1, wherein said at least two pre-existing weapons system signals comprise an arming signal and a firing signal.

5. The electronically controlled apparatus of claim 4, wherein said logic circuit controls said lanyard retention mechanism to disengage the lanyard in response to said arming signal being in an off state and said firing signal being in an on state.

6. The electronically controlled apparatus of claim 4, wherein said logic circuit controls said lanyard retention mechanism to retain the lanyard in response to said arming signal being in an off state and said firing signal being in an off state.

7. The electronically controlled apparatus of claim 4, wherein said logic circuit controls said lanyard retention mechanism to retain and lock the lanyard in response to said arming signal being in an on state and said firing signal being in either an off or an on state.

8. An electronically controlled apparatus for arming weapons armed by pulling a lanyard upon release of the weapon from a weapon base, comprising:

a lanyard retention mechanism adapted to engage and disengage the lanyard in response to a logic circuit; and said logic circuit having inputs to receive at least two pre-existing weapons system signals and adapted to control said lanyard retention mechanism in response to said weapons system signals, wherein said at least two pre-existing weapons system signals comprise an arming signal and a firing signal, and, the apparatus further comprising a selector unit for selecting one of an open mode, a normal mode, or a locked mode.

9. The electronically controlled apparatus of claim 8, wherein selection of said open mode provides said firing signal to said logic circuit in an on state and said arming signal to said logic circuit in an off state, and said logic circuit controls said lanyard retention mechanism to disengage the lanyard in response to said arming and firing signals.

10. The electronically controlled apparatus of claim 8, wherein selection of said normal mode provides said firing signal to said logic circuit in an off state and said arming signal to said logic circuit in an off state, and said logic circuit controls said lanyard retention mechanism to retain the lanyard in response to said arming and firing signals.

11. The electronically controlled apparatus of claim 8, wherein selection of said locked mode provides said firing signal to said logic circuit in an off or an on state and said arming signal to said logic circuit in an on state, and said logic circuit controls said lanyard retention mechanism to retain and lock the lanyard in response to said arming and firing signals.

12. An electronically controlled apparatus for arming weapons armed by pulling a lanyard upon release of the weapon from a weapon base, comprising:

a lanyard retention mechanism adapted to engage and disengage the lanyard in response to a logic circuit; and said logic circuit having inputs to receive at least two pre-existing weapons system signals and adapted to control said lanyard retention mechanism in response to said weapons system signals, wherein said at least two pre-existing weapons system signals comprise an arming signal and a firing signal, and wherein said firing signal and said arming signal are twenty eight volt electrical signals.

13. The electronically controlled apparatus of claim 8, wherein said logic circuit, upon selection of said normal mode, does not provide power to said solenoid such that said solenoid remains extended and the lanyard engaged.

14. The electronically controlled apparatus of claim 8 wherein said logic circuit, upon selection of said open mode, applies power to said solenoid such that said solenoid retracts and disengages the lanyard.

15. The electronically controlled apparatus of claim 8 wherein said logic circuit, upon selection of said locked mode, does not apply power to said solenoid such that said solenoid remains extended and locks the lanyard engaged with said retention mechanism.

16. The electronically controlled apparatus of claim 1 wherein the logic circuit comprises circuitry for preventing said lanyard retention mechanism from engaging the lanyard if a short circuit develops in a solenoid of said lanyard retention mechanism.

* * * * *

UNITED STATES PATENT AND TRADEMARK OFFICE

CERTIFICATE OF CORRECTION

PATENT NO. : 6,584,880 B1 
DATED : July 1, 2003
INVENTOR(S) : Randall Pahl, Marcus Snell and Carl Nicodemus It is certified that error appears in the above-identified patent and that said Letters Patent is hereby corrected as shown below:

Column 1,
Line 5, insert the following
-- This invention was made with Government support under contract No. N00019-96-D-0159 awarded by the Department of the Navy. The Government has certain rights in this invention. --

Signed and Sealed this

Twenty-fifth Day of November, 2003

JAMES E. ROGAN
*Director of the United States Patent and Trademark Office*